US011773616B2

(12) United States Patent
Wowak

(10) Patent No.: US 11,773,616 B2
(45) Date of Patent: Oct. 3, 2023

(54) OUTDOOR SHELTER AND METHODS OF DEPLOYING THE OUTDOOR SHELTER

(71) Applicant: Daniel Wowak, Mahanoy City, PA (US)

(72) Inventor: Daniel Wowak, Mahanoy City, PA (US)

( * ) Notice: Subject to any disclaimer, the term of this patent is extended or adjusted under 35 U.S.C. 154(b) by 0 days.

(21) Appl. No.: 16/859,474

(22) Filed: Apr. 27, 2020

(65) Prior Publication Data

US 2021/0332603 A1 Oct. 28, 2021

(51) Int. Cl.
*E04H 15/04* (2006.01)
*E04H 15/54* (2006.01)

(52) U.S. Cl.
CPC ..... *E04H 15/04* (2013.01); *E04H 15/54* (2013.01)

(58) Field of Classification Search
CPC ..... E04H 15/04; E04H 15/02
See application file for complete search history.

(56) References Cited

U.S. PATENT DOCUMENTS 785,582 A * 3/1905 Stempel ..... E04H 15/04 135/90
972,731 A * 10/1910 Conley ..... B21J 15/14 227/52
1,048,806 A * 12/1912 Burch ..... E04H 15/30 135/95
1,116,074 A * 11/1914 Jones ..... E04H 15/04 135/90
1,202,475 A * 10/1916 Brent ..... E04H 15/04 135/90
1,215,139 A * 2/1917 Gail, Jr. ..... A41D 15/04 2/89
1,658,214 A * 2/1928 Thomas ..... E04H 15/04 135/87
2,263,867 A * 11/1941 Barnard ..... E04H 15/04 135/90
2,567,697 A * 9/1951 Craighead, Jr. ..... E04H 15/04 135/90
3,442,275 A * 5/1969 Ternes ..... A01M 31/00 135/87
3,621,858 A * 11/1971 Steele ..... E04H 15/30 135/87
4,471,794 A * 9/1984 Kirkham, Jr. ..... E04H 15/30 135/95
5,769,106 A * 6/1998 Achuff ..... A41D 15/04 135/95
5,853,016 A * 12/1998 Cowan ..... E04H 15/54 135/90

(Continued)

*Primary Examiner* — David R Dunn
*Assistant Examiner* — Danielle Jackson
(74) *Attorney, Agent, or Firm* — Barley Snyder

(57) ABSTRACT

An outdoor shelter having a tarp, a first loop at a first corner of the tarp on a first edge of the tarp, a second loop at a second corner of the tarp on the first edge of the tarp, a first rope at a first corner of the tarp on a second edge of the tarp opposite and parallel to the first edge of the tarp, and a second rope at a second corner of the tarp on the second edge of the tarp. The tarp, the first loop, the second loop, the first rope, and the second rope are stored in a pouch fixed to the tarp when the shelter is not in use. When needed, this outdoor shelter can be deployed in the shape of a lean-to or in the shape of a pointed snow plow.

3 Claims, 5 Drawing Sheets

(56) References Cited

U.S. PATENT DOCUMENTS

| | | | | |
|---|---|---|---|---|
| 5,924,132 | A * | 7/1999 | Wigutow | A45F 4/14 2/69 |
| 6,341,379 | B1 * | 1/2002 | Kokus | A41D 15/04 135/95 |
| 8,544,922 | B1 * | 10/2013 | Huzar | B65D 85/52 294/214 |
| 8,695,859 | B1 * | 4/2014 | Stalker | A01M 31/025 224/577 |
| 9,903,134 | B2 * | 2/2018 | Munnerlyn | E04H 15/54 |
| 10,190,292 | B1 * | 1/2019 | Shackelford | E03B 3/03 |
| 10,307,002 | B2 * | 6/2019 | Distefano | A47G 9/0223 |
| 2014/0014150 | A1 * | 1/2014 | Horner | E04H 15/04 135/90 |
| 2014/0352842 | A1 * | 12/2014 | McEvilly | E04H 15/04 141/69 |
| 2018/0283037 | A1 * | 10/2018 | McDonald | E04H 15/04 |
| 2019/0338551 | A1 * | 11/2019 | Wiseman | E04H 15/04 |

* cited by examiner

FIG. 7
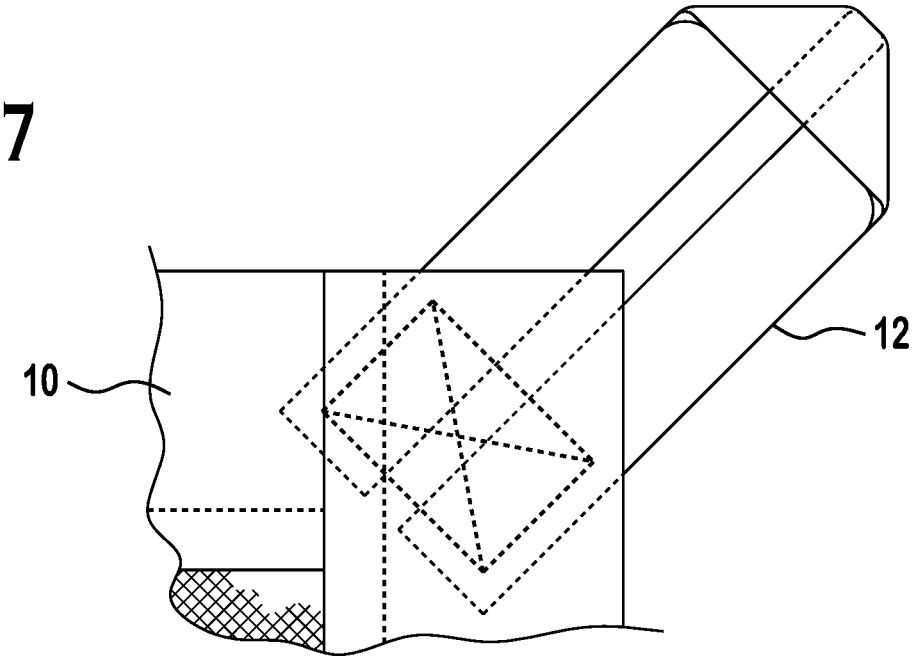
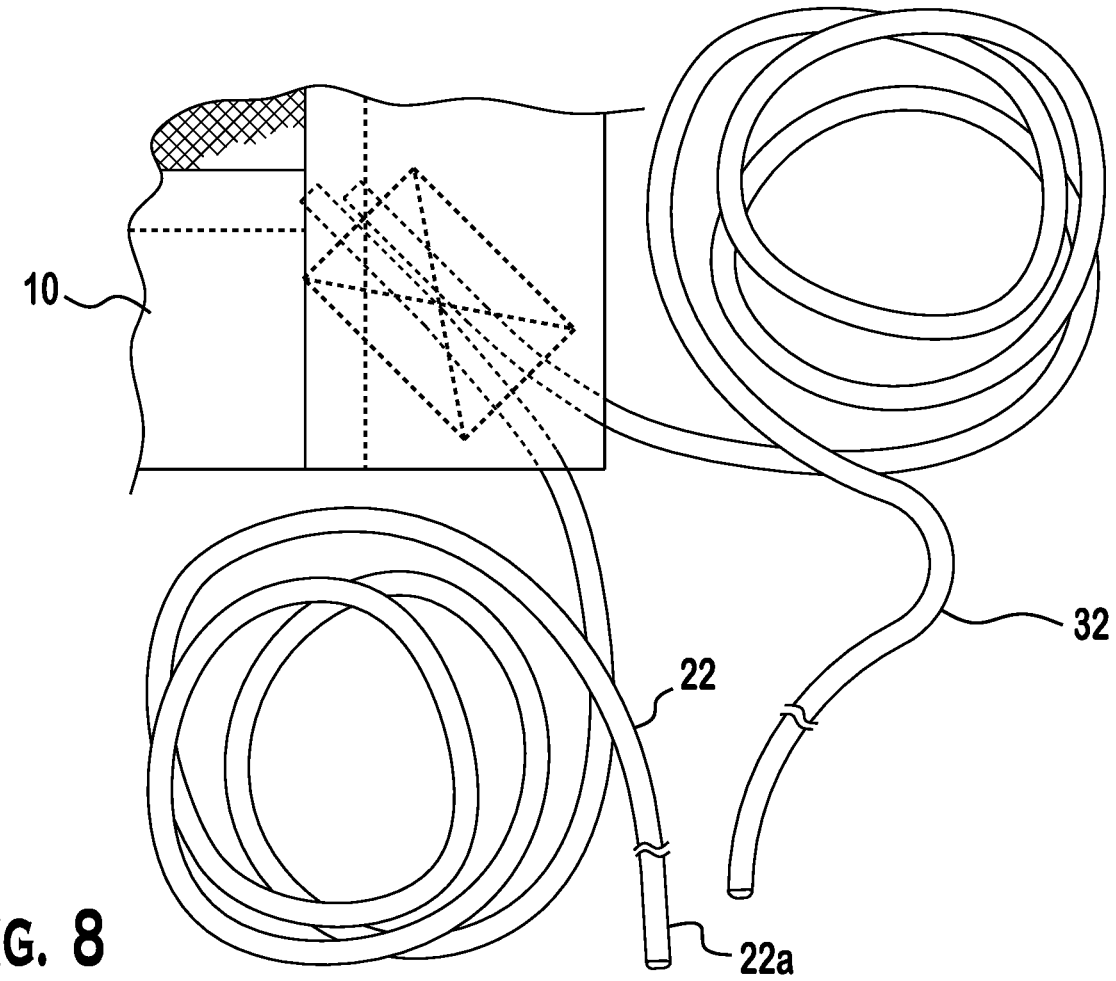
FIG. 8

OUTDOOR SHELTER AND METHODS OF DEPLOYING THE OUTDOOR SHELTER

FIELD OF THE INVENTION

The present invention relates, in general, to shelters for individuals recreating outdoor and, in particular, to an outdoor shelter that provides protection for outdoor enthusiasts from inclement weather and methods for deploying this outdoor shelter.

BACKGROUND

One very important requirement for outdoor enthusiasts is that they know how to protect themselves from foul weather and have the means for protecting themselves from foul weather. This involves having a shelter that will protect them from foul weather that is easy to deploy in relatively quick time.

SUMMARY

An outdoor shelter, constructed in accordance with the present invention, includes a tarp, a first loop at a first corner of the tarp on a first edge of the tarp, a second loop at a second corner of the tarp on the first edge of the tarp, a first rope a first corner of the tarp on a second edge of the tarp opposite and parallel to the first edge of the tarp, and a second rope at a second corner of the tarp on the second edge of the tarp. This outdoor shelter also has a pouch fixed to the tarp and sized to contain the tarp, the first loop, the second loop, the first rope, and the second rope.

An outdoor shelter, constructed in accordance with the present invention, can be deployed in the shape of a lean-to and in the shape of a pointed snow plow. First, the tarp, the first loop fixed to the tarp, the second loop fixed to the tarp, the first rope fixed to the tarp, and the second rope fixed to the tarp are removed from the pouch. Next, a free end of the first rope is pulled around a first support structure and is tied to a selected location on the first rope. Next, a free end of the second rope is pulled around a second support structure and is tied to a selected location on the second rope. Next, the first loop and the second are secured to a base surface.

BRIEF DESCRIPTION OF THE DRAWINGS

FIG. 5 is a rear view an outdoor shelter constructed in accordance with the present invention deployed in the shape of a lean-to.

FIG. 6 is a side view of an outdoor shelter constructed in accordance with the present invention deployed in the shape of a lean-to.

FIG. 7 is a top view, on an enlarged scale, of a corner of the tarp having a loop.

FIG. 8 is a top view, on an enlarged scale, of a corner of the tarp having two ropes.

DETAILED DESCRIPTION OF THE INVENTION

Figure 1:
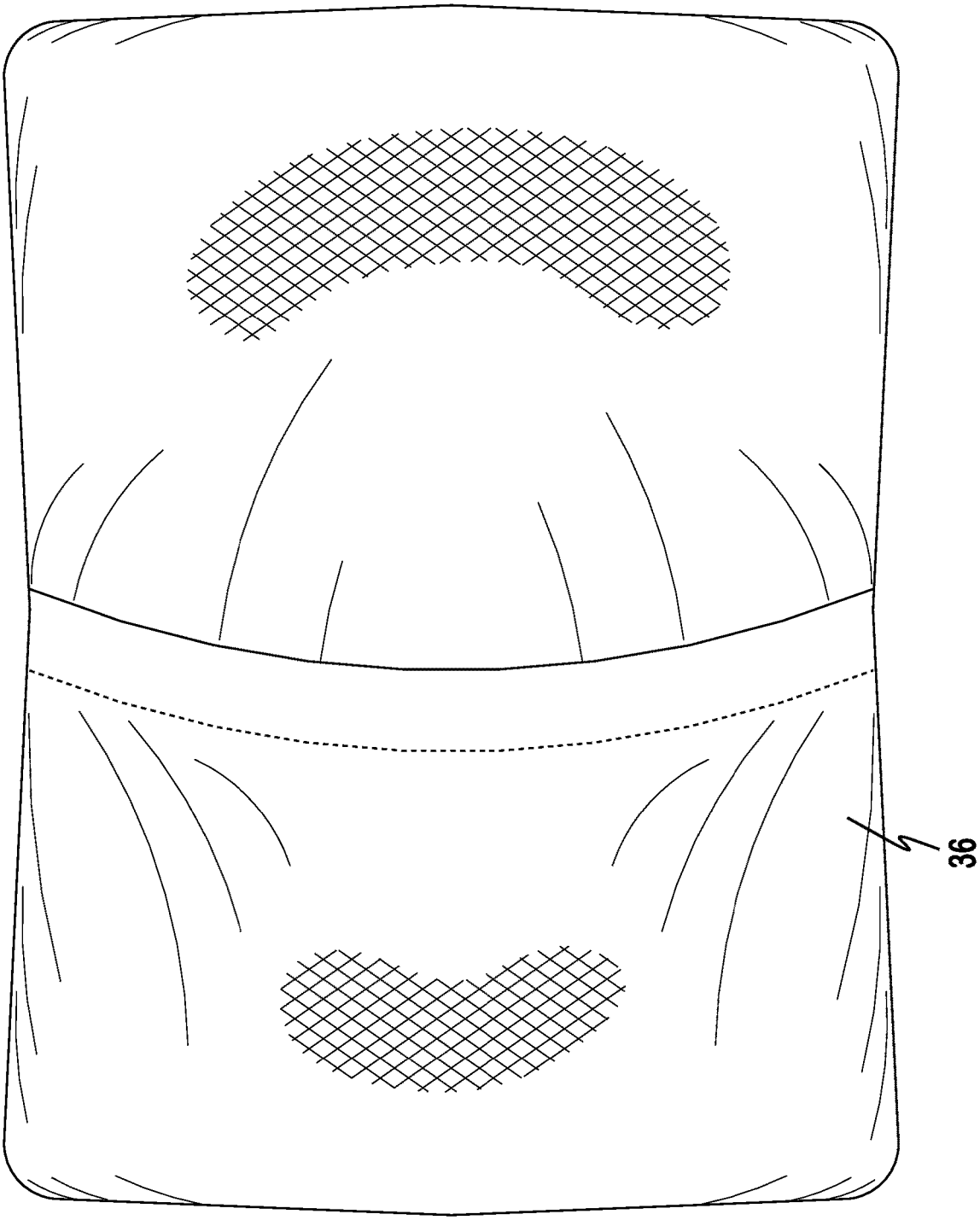
FIG. 1 is a top view of a pouch containing the other parts of an outdoor shelter constructed in accordance with the present invention, namely a tarp, loops, and ropes.
Figure 2:
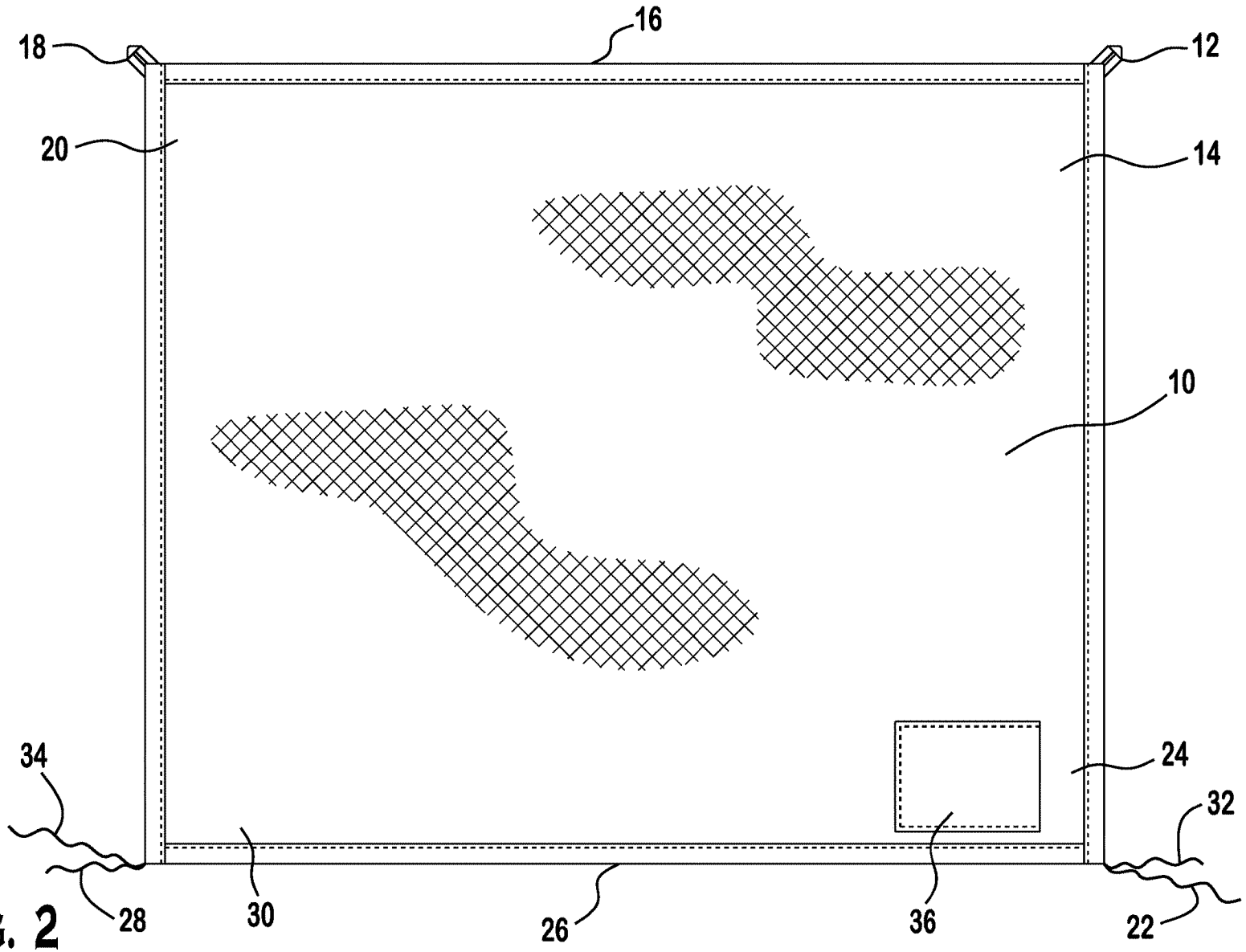
FIG. 2 is a top view of the contents of the pouch shown in FIG. 1, namely a tarp, loops, and ropes.
Figure 3:
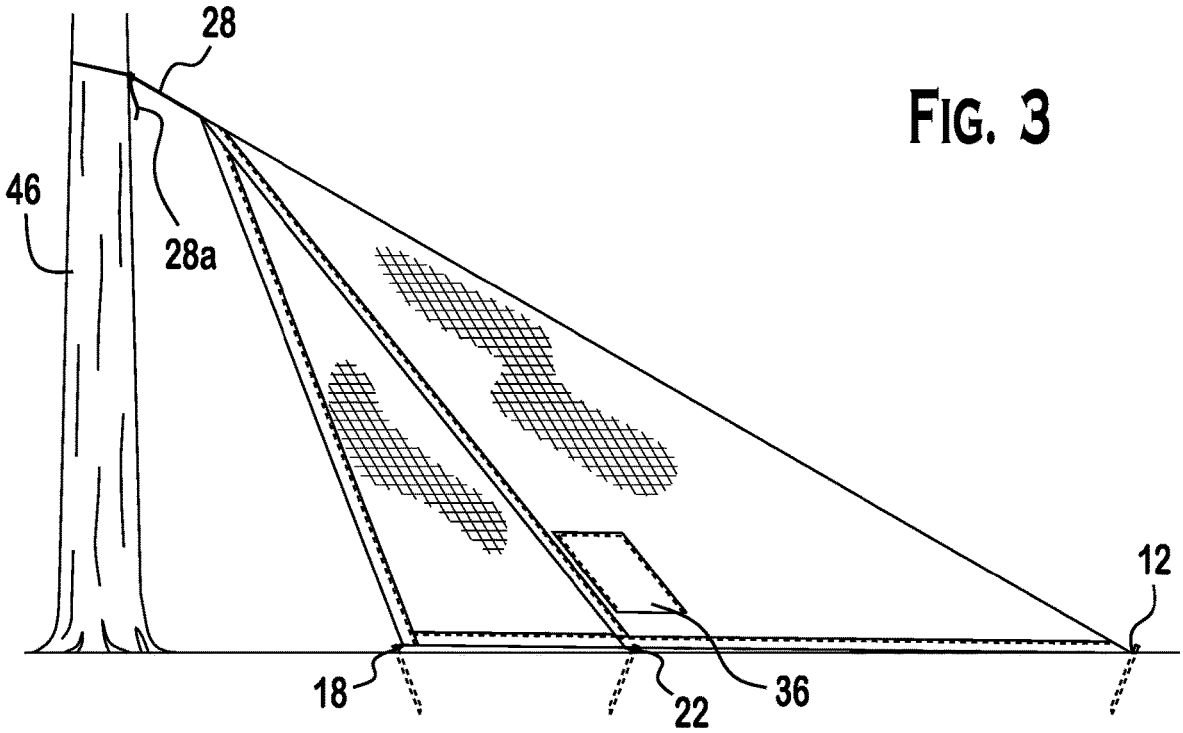
FIG. 3 is a side view of an outdoor shelter constructed in accordance with the present invention deployed in the shape of a pointed snow plow.
Figure 4:
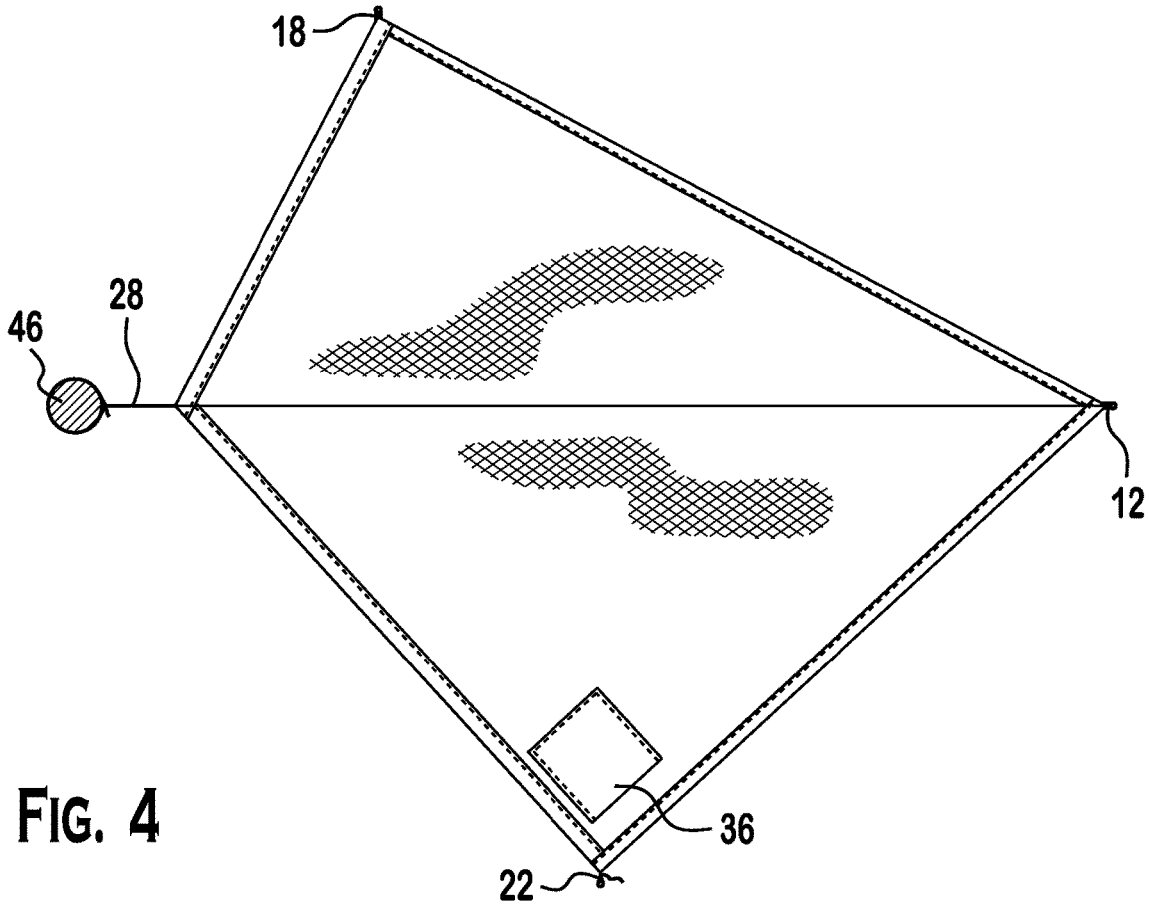
FIG. 4 is a top view of an outdoor shelter constructed in accordance with the present invention deployed in the shape of a pointed snow plow.
Figure 5:
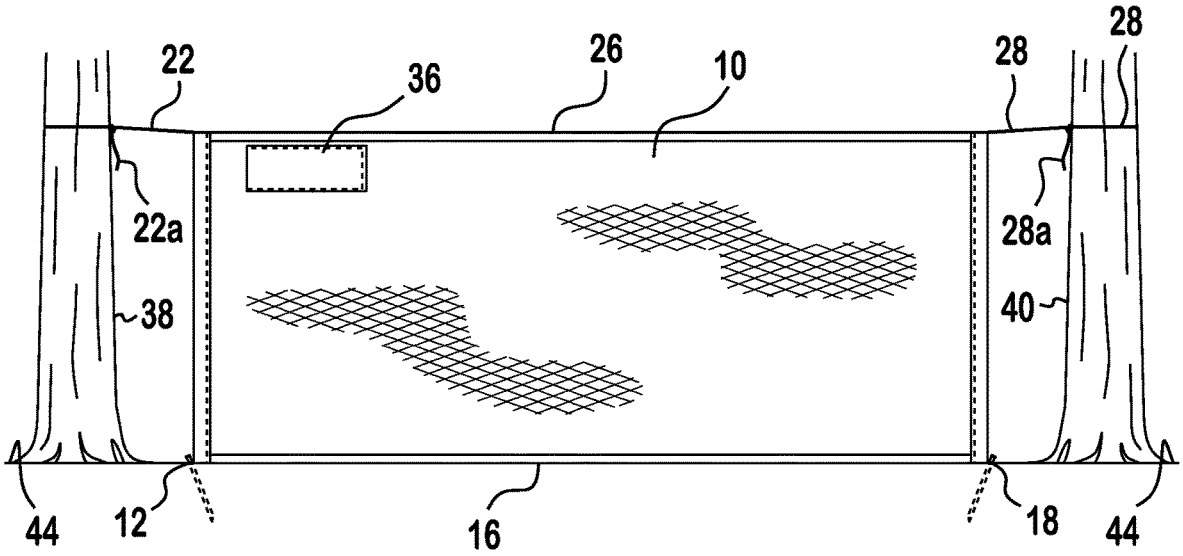
Figure 6:
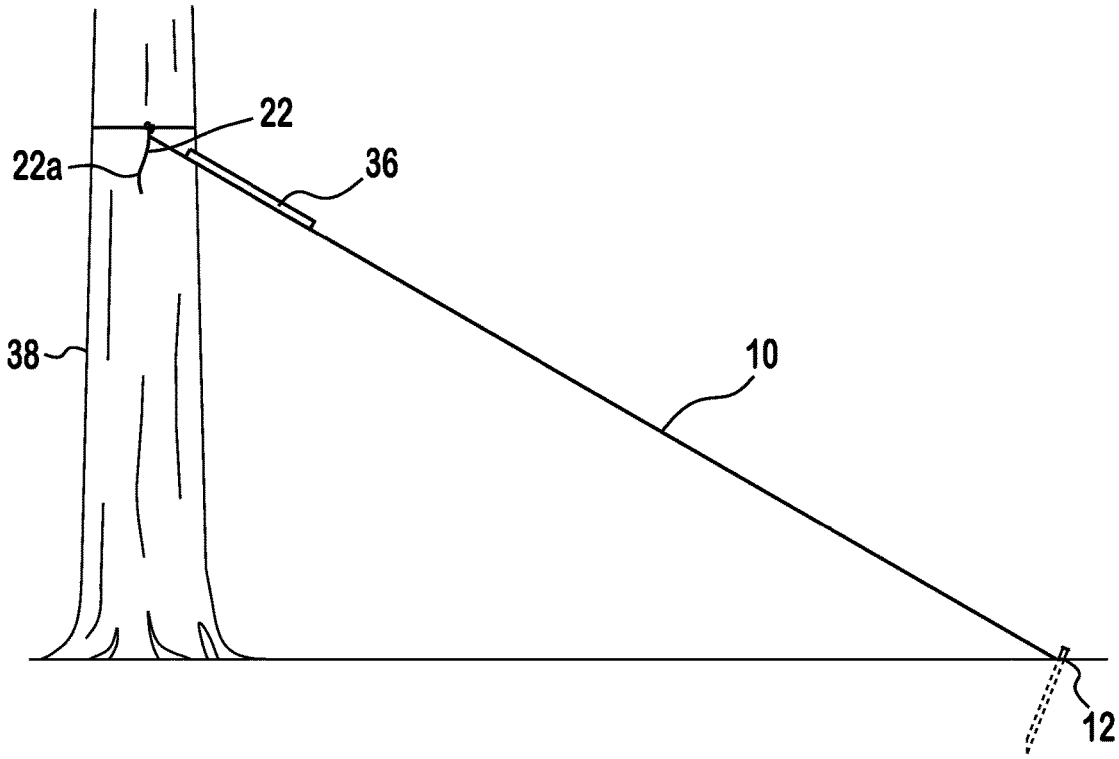

Referring to FIGS. 1, 2, 7, and 8, an outdoor shelter, constructed in accordance with the present invention, includes a tarp 10. Tarp 10 is made of a waterproof, flexible, tear-resistant material, such as Xenon. However, one skilled in the art should appreciate that other material could be used. Tarp 10 has a size and a shape that, when deployed, it has the shape of a lean-to as illustrated in FIGS. 5 and 6 or as a pointed snow plow as illustrated in FIGS. 3 and 4. For the embodiment of the present invention illustrated and being described, tarp 10 is rectangular.

An outdoor shelter, constructed in accordance with the present invention, also includes a first loop 12 at a first corner 14 of tarp 10 on a first edge 16 of the tarp and a second loop 18 at a second corner 20 of the tarp on the first edge of the tarp. For the embodiment of the present invention illustrated and being described, loops 12 and 18 are ribbon loops that have sufficient width to fulfill a function that will be described below.

An outdoor shelter, constructed in accordance with the present invention, further includes a first rope 22 at a first corner 24 of tarp 10 on a second edge 26 of the tarp opposite and parallel to first edge 16 of the tarp and a second rope 28 at a second corner 30 of the tarp on the second edge of the tarp. For the embodiment of the present invention illustrated and being described, the outdoor shelter has a third rope 32 at first corner 24 of tarp 10 on second edge 26 of the tarp and a fourth rope 34 at second corner 30 of the tarp on the second edge of the tarp.

An outdoor shelter, constructed in accordance with the present invention, further includes a pouch 36 fixed to tarp 10 and sized to contain the tarp, first loop 12, second loop 18, first rope 22, second rope 28, third rope 32, and fourth rope 34. For the embodiment of the invention illustrated and being described, pouch 36 is fixed to tarp 10 at a corner of the tarp, namely corner 24.

Tarp 10 can be deployed in the shape of a lean-to, as illustrated in FIGS. 5 and 6, and in the shape of a pointed snow plow, as illustrated in FIGS. 3 and 4.

Deploying the Lean-to —FIGS. 5 and 6

Initially, tarp 10, first loop 12, second loop 18, first rope 22, second rope 28, third rope 32, and fourth rope 34 are removed from pouch 36.

A free end 22*a* of rope 22 is pulled around a first support structure, such as a tree 38, and is tied either to a selected location of rope 22 or to the free end of rope 32 which also has been pulled around tree 38.

A free end 28*a* of rope 28 is pulled around a second support structure, such as a tree 40, and is tied either to a selected location of rope 28 or to the free end of rope 34 which also has been pulled around tree 40.

First loop 12 is staked to a base surface, such as the ground 44.

Second loop 18 is staked to the base surface 44.

Deploying the Pointed Snow Plow Shape—FIGS. 3 and 4

Initially, tarp 10, first loop 12, second loop 18, first rope 22, second rope 28, third rope 32, and fourth rope 34 are removed from pouch 36.

Free end 28*a* of rope 28 is pulled around a support structure, such as a tree 46, and is tied either to a selected location of rope 28 or to a free end of rope 34 which also has been pulled around tree 46.

Free end of rope 22 is staked to the ground.

First loop 12 is staked to the ground.

Second loop 18 is staked to the ground.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A method for deploying an outdoor shelter comprising the steps of:

providing an outdoor shelter having:

(a) a planar single tarp, (b) a first loop at a first corner of the tarp on a first edge of the tarp, (c) a second loop at a second corner of the tarp on the first edge of the tarp, (d) a first rope and a third rope at a first corner of the tarp on a second edge of the tarp opposite and parallel to the first edge of the tarp, (e) a second rope and a fourth rope at a second corner of the tarp on the second edge of the tarp, and (f) a pouch fixed to a body of the tarp, the pouch is positioned next to the first rope and the third rope and sized to contain the tarp, the first loop, the second loop, the first rope, the second rope, the third rope, and fourth rope;

removing the tarp, the first loop, the second loop, the first rope, the second rope, the third rope and the fourth rope from the pouch, pulling a free end of the first rope and a free end of the third rope around a support structure;

tying the free end of the first rope and the free end of the third rope to a selected location on the first rope, and the third rope;

securing the first loop to a base surface;

securing the second loop to the base surface; and securing the second rope and the fourth rope to the base surface.

2. The outdoor shelter according to claim 1, wherein the tarp is made of a waterproof, flexible, tear-resistant material.

3. The outdoor shelter according to claim 2, wherein the tarp is made of Xenon.

* * * * *